US006298708B1

(12) United States Patent
Gaul et al.

(10) Patent No.: US 6,298,708 B1
(45) Date of Patent: Oct. 9, 2001

(54) TOOL-HOLDER ASSEMBLY FOR A MACHINE TOOL

(75) Inventors: Kurt Gaul; Wolfgang Ausländer, both of Wuppertal (DE)

(73) Assignee: Gebr. Hilgeland GmbH & Co., Wuppertal (DE)

( * ) Notice: Subject to any disclaimer, the term of this patent is extended or adjusted under 35 U.S.C. 154(b) by 0 days.

(21) Appl. No.: 09/447,695

(22) Filed: Nov. 23, 1999

(30) Foreign Application Priority Data

Nov. 24, 1998 (DE) ..... 198 54 150

(51) Int. Cl.[7] ..... B21D 22/00

(52) U.S. Cl. ..... 72/442; 72/446; 72/472; 470/138; 470/140; 83/561

(58) Field of Search ..... 470/57, 58, 205, 470/184, 191, 140, 137, 138; 72/442, 446, 447; 83/559, 561

(56) References Cited

U.S. PATENT DOCUMENTS

| | | | | |
|---|---|---|---|---|
| 1,036,047 | * | 8/1912 | Wilcox | 470/138 |
| 1,297,429 | * | 4/1919 | Wilcox | 470/138 |
| 1,905,084 | * | 4/1933 | Fieg | 470/210 |
| 1,955,061 | * | 4/1934 | Freidman | 470/138 |
| 2,104,297 | * | 1/1938 | Freidman | 470/140 |
| 2,124,022 | * | 7/1938 | Alberts | 470/138 |
| 2,204,043 | * | 6/1940 | MacIagan | 470/138 |
| 3,359,580 | * | 12/1967 | Osman et al. | 470/138 |
| 4,397,172 | * | 8/1983 | Garlaschi | 470/140 |

FOREIGN PATENT DOCUMENTS

| | | |
|---|---|---|
| 38 18 001 | 1/1989 | (DE) . |
| 2 161 733 A | 1/1986 | (GB) . |

* cited by examiner

*Primary Examiner*—David Jones
(74) *Attorney, Agent, or Firm*—Herbert Dubno

(57) ABSTRACT

A tool holder having a plurality of tools fixed thereon is used in a production machine such as a production press to position one tool after the other opposite a workpiece holder. All of the tools perform the same operation and can be brought into position by a pneumatic cylinder which can angularly displace a pinion engaging a rack.

20 Claims, 3 Drawing Sheets

TOOL-HOLDER ASSEMBLY FOR A MACHINE TOOL

FIELD OF THE INVENTION

My present invention relates to a tool-holder assembly for a machine tool, especially a press, wherein the tool holder is equipped with a plurality of tools, especially press rams, plungers or stampers and whereby the tool holder is movable in a working motion toward a workpiece which is held in a parts holder or die so that the too land die together shape the workpiece. The invention is especially directed to production machine tools of this type wherein, after a certain run, the wear of the stamping tool necessitates its replacement, usually by an identical tool performing the same operation.

BACKGROUND OF THE INVENTION

Especially in the case of machine tools used for mass production, for example, the mass production of screws or bolts, productivity is determined by the weakest link in the production train. In the manufacture of screws, for example, this weak link has been in the past the stamper, plunger or ram of the press which had to be replaced after a relatively limited run. The press run, depending upon the particular product and the material from which the product was made, could amount to 30,000 to 250,000 pieces.

In a high-capacity press, capable of producing 800 pieces per minute, it was not uncommon to have to replace the ram or plunger tool every two hours. The replacement process was relatively time consuming and required that the apparatus be brought to a costly standstill, thereby limiting productivity.

To reduce the drop in productivity and to allow tool replacement with little investment in labor, it has been proposed to provide an automatic tool-replacement system. For this purpose, a number of identical tools, for example, stamping tools, were stored in a magazine and fed from the magazine to the tool holder. A mechanism was provided for removing a stamping tool from the tool holder, inserting it into the tool holder, removing the worn tool from the tool holder and placing it in the magazine and advancing the tool in the magazine to the replacement position. The tools could then be removed from the magazine for machining or refinishing.

The tool holder had to be arrested in a certain position for the tool change and, especially when the tool did not have a regular shape, there was always the danger that the tools in the magazine would jam against one another, delaying the withdrawal of a tool or the reinsertion of a worn tool into the magazine. As a consequence, in spite of the automatic tool replacement mechanism and the availability of a magazine with a store of replacement stamping tools, there was always the danger of delay in the tool chain and of a productivity drop.

OBJECTS OF THE INVENTION

It is the principal object of the present invention, therefore, to provide an alternative tool replacement system for a tool magazine whereby the drawbacks of the former approach can be avoided and productivity drops which were so associated therewith can be eliminated.

Another object of the invention is to provide an improved tool replacement system for a machine tool, especially a production press, whereby productivity drops caused by defective tools in a magazine or tool jamming and the like can be avoided.

Still another object of the invention is to provide a tool replacement system which minimizes the amount of manual labor required and the down time to which a press may be subject in undergoing tool replacement.

SUMMARY OF THE INVENTION

These objects and others are attained, in accordance with the invention by mounting a plurality of identical tools, capable of being substituted for one another upon wear of the one in use, rigidly on a tool holder and moving them with the tool holder into the operative or working position. More particularly, a tool-holder assembly for a machine tool can comprise:

- a support movable toward and away from a workpiece holder in a working motion;
- a tool holder having a plurality of tools fixed thereon for performing a certain machining operation and alternatively positionable at a workpiece-shaping position for performing the operating upon wearing of the tools, the tool holder being movable on the support in a tool-replacement motion; and
- positioning means operatively connected with the tool holder for shifting same with the tool-replacement motion to substitute one of the tools for another at the workpiece-shaping position.

The system is particularly desirable when the machine tool is a production press, the tools are stamping tools of the press, e.g. for stamping and shaping the heads of screws or the like and the workpiece holder is the anvil of such a press shaping the workpiece in conjunction with the stamping die.

By fastening the tools fixedly in the tool holder, it is unnecessary to display individual tools relative to the tool holder so that jamming in a magazine or the like can be avoided. The number of tools which can be mounted on the tool holder is practically unlimited and will be chosen so that each tool can produce a fraction of the tool run and the total number of tools can produce an entire production run as the tools are substituted for one another and without a significant downtime since the tools can be substituted for one another in the time it takes for the press to open and close normally. The personnel utilization is minimal and down time need occur only when the production line is brought to standstill for another operation.

The tool holder is so constructed that it is moved as a unit, i.e. with all of the tools mounted thereon, toward the parts holder or fixed die member for the working motion. In this working motion, however, only one of the tools on the tool holder is aligned with the workpiece and thus can participate in the shaping operation. While the invention is described here primarily in conjunction with a production press, it will be understood that it also applicable to other production machine tools, although it is particularly important for such a press.

When the workpiece in use has worn sufficiently that the workpieces which it produces can be considered rejects, a new tool is shifted into the working position and production continued with the new tool until that tool begins to produce rejects and a further tool change is carried out.

For the movement of the tool holder to bring a tool into the working position, it is advantageous to mount the tool holder so that it is slidable in a rail. The use of a rail system to slidably support the tool holder enables the entire tool holder to be removed from the rail and replaced by another tool holder which is identical to the first one which has previously been equipped with a corresponding set of tools so that the worn tools on the replaced tool holder can be removed or machined to restore their effectiveness.

After replacement of the individual tools on the removed tool holder, the latter can again be substituted on the rail for the tool holder then in use. To position the tool holder on the rail, for example, so that the first of its tools is in line with the workpiece and is in position for a stamping operation, a stop can be provided on the rail for the tool holder.

It has been found to be advantageous to provide the positioning means for the tool holder with a pinion whose teeth mesh with a rack on the tool holder. The pinion itself can be driven in a variety of ways. Advantageously, the pinion is advanced through a given angular displacement corresponding to the linear displacement of the tool holder by a distance D between the tools mounted on the tool holder. This displacement, therefore suffices to remove a worn tool from the shaping position and replace it by a fresh tool and corresponds to the pitch of the tools in their linear array along the tool holder. This discrete motion can be effected by a pneumatic cylinder which can angularly displace a lever. The angular displacement of the pinion and thus the linear movement of the tool holder can correspond to a maximum stroke of the piston rod of the cylinder.

To allow return of the piston rod to its starting position without rotation of the pinion, the pinion can be mounted on its shaft by an overrunning clutch. The rotation of the pinion is thus unidirectional in spite of the bidirectional movement of the piston rod.

It has been found to be advantageous, moreover, to make the spacing between the tools on the tool holder constant. In this case, the piston rod can have a stop which limits its stroke and its full stroke can correspond to the angular displacement of the pinion required to move the tools by one increment of tool spacing. The gearing ratio and the lever ratio are selected accordingly.

To reduce the mass which must be moved in the working stroke of the press, the pneumatic cylinder and the pinion can be fixed on the machine frame and only the tool holder and its rail, with the individual tools mounted on the tool holder, need be displaced in the pressing operation. In that case, the teeth of the pinion and/or rack can be elongated so that the teeth of the pinion and rack slide along one another during the working motion of the press.

So that the teeth remain engaged for the full working stroke of the press, the pinion should have a width which exceeds the width of the rack by an amount equal to the working stroke of the machine.

Since the alignment of the working tool and the workpiece to be shaped is of great importance with respect to the quality of the product, the positioning means which have been described are used for the coarse movement of the tool holder to coarsely position the working tool and the workpiece in alignment, a fine positioning and arresting mechanism is provided. The fine positioning and arresting mechanism can include a number of holes formed in the tool holder equal to the number of tools in the set of tools mounted on the tool holder and a pin which is indexable in the selected holes.

According to the invention, the pin and the holes have matching conical shapes so that the tool holder is self aligning on the pin. The distance between the tools or bores can be equal to the spacing D previously mentioned between tools.

Advantageously, the pin is spring loaded into the selected hole and the spring-loading maintains the indexing of the tool holder during the press operation.

To withdraw the pin to enable a tool change, a pneumatic cylinder can be connected by a lever mechanism to the pin and operates the spring-loading force. This pneumatic cylinder can operate in conjunction with the pneumatic cylinder for stepping the pinion so that the pin is withdrawn for the advance of a new tool into position and the pin automatically jumps into a new hole or bore when the new tool is in the workpiece-shaping position.

In an alternative construction, the tool holder can be mounted so that it is rotatable or pivotable about an axis. For positioning a new tool in the workpiece shaping position and displacing a previous tool therefrom, the tool holder is rotated and locked in place by a pin. In this case the angular displacement of the tool holder for successive tool positioning is in constant angular increments. The rotation can use a similar pinion and cylinder arrangement or some other mechanism.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
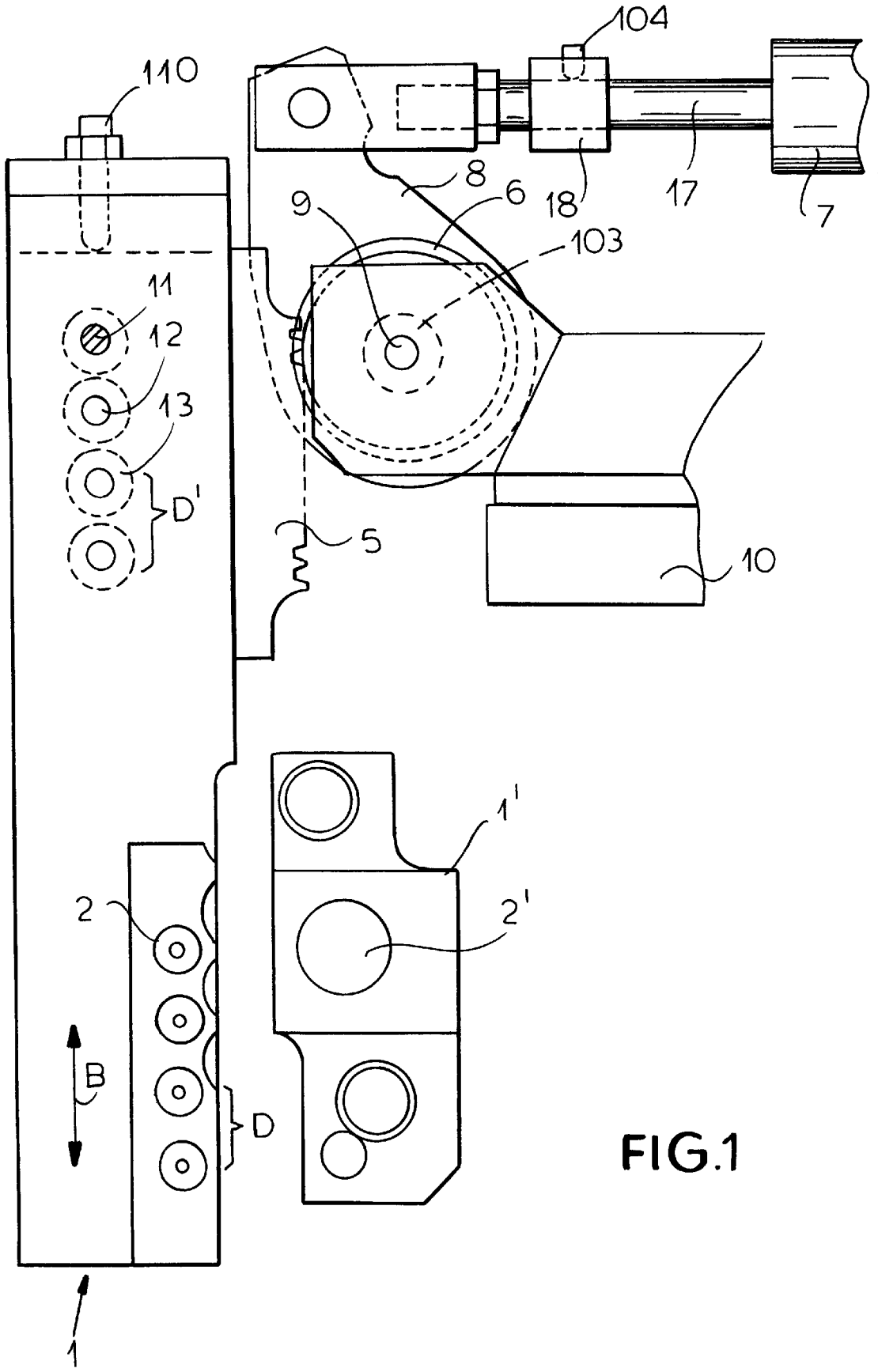
FIG. 1 is a front view showing the significant parts of an apparatus according to the invention.
Figure 2:
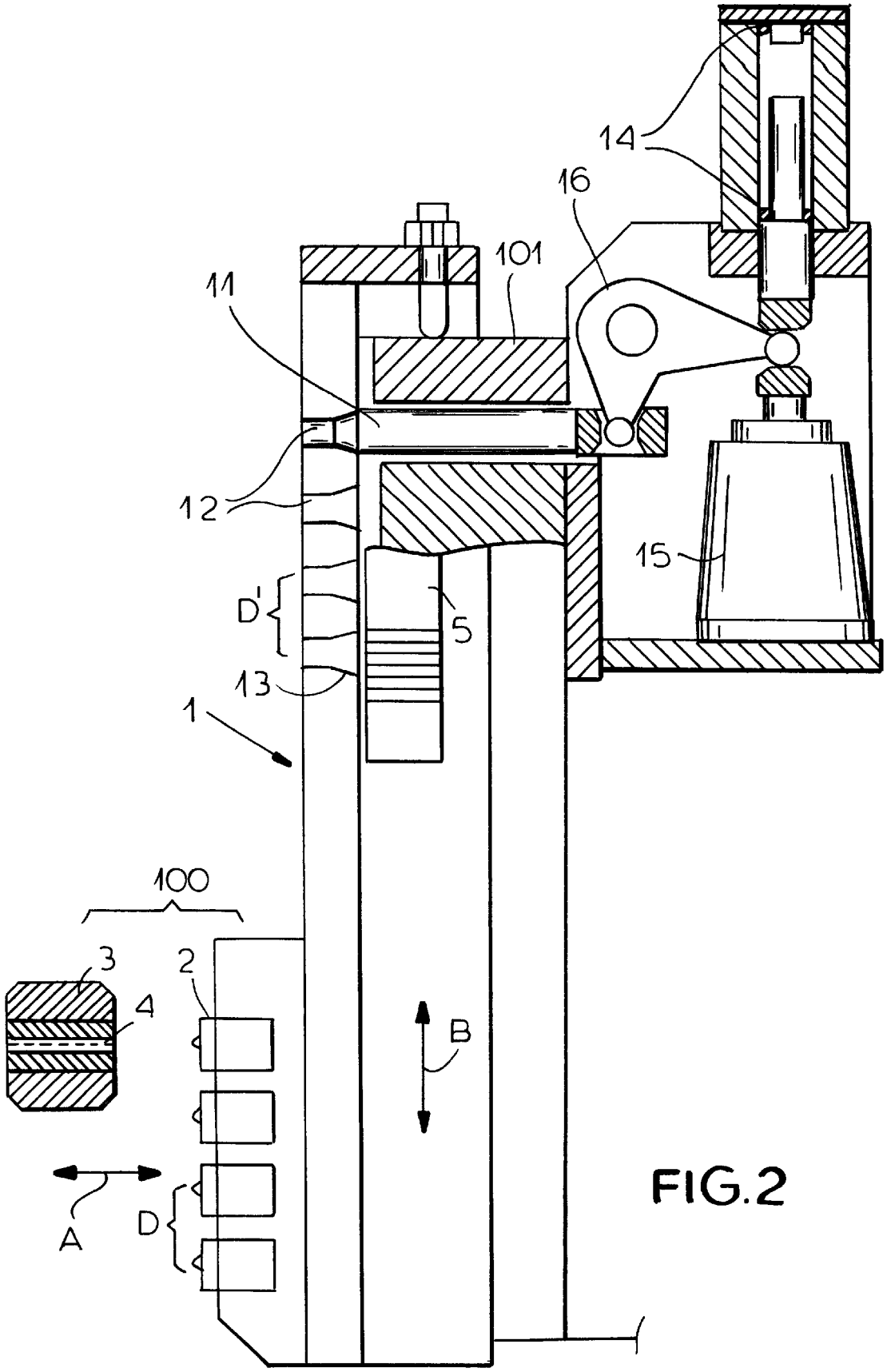
FIG. 2 is a side elevational view, partly broken away of some of these elements.

The embodiment shown in FIGS. 1 and 2 comprises a press generally represented at 100 and of which the movable portion on a machine frame 10 comprises a tool holder 1 which is used for the production of large runs of pieces, especially screws and the like. In the embodiment shown, the head of the screws is provided with a cross slot between the stamping tool and the anvil or supporting die and the product is therefore a Phillips-head screw. The tool holder has been represented at 1, the die has been shown at 3 and a workpiece in the die is represented at 4.

According to the invention, on the tool holder 1, a multiplicity of stamping tools 2 are mounted. The tools 2 are rigidly and immovably connected to the tool holder 1. FIG. 1 shows, in addition to the tool holder 1 of the invention, a conventional tool holder 1' carrying a single press ran 1', e.g. for forming other shapes on the workpieces. The use of two or more tool holders in a given press is advantageous in the formation of workpieces which are shaped in two or more different steps against a common die.

Thus in the production of screws, a coining head 1' with a coining tool 2' can be provided to impart the head shape to the screw and the cross slot can then be formed by one of the tools 2 mounted on the tool holder 1. The die 3 can be a rotary die so that a plurality of different fabrication steps can be carried out on a part held in the die. The die structure is not shown in detail. In a first position of the die in its rotary path, the workpiece may be performed and in a further rotation of the die, the head can be coined thereon. In a third position the cross slot can be shaped in the screws and the finished configuration imparted to the latter and in a fourth position in the rotation of the die, the workpiece can be ejected.

In the operation described, the wear on each of the tools 2 is significantly greater than the wear on the tool 2' and it is usually required to change the tools 2 after the production of 30,000 to 250,000 pieces. The wear of tip 2 can significantly reduce the quality of the product, leading to considerable rejects. Hence a number of tools 2 which must be used before a tool 2' requires replacement, at least, are mounted on the tool holder 1. The tools 2 are spaced apart by distances D, also referred to as the pitch of the tools, in a tool-replacement motion represented by the double-headed screw B. According to the invention, therefore, prior to the occurrence of rejects and after some wear of each tool 2, the tool holder is moved in a direction represented by the arrow B to align a new tool 2 with the die 3, i.e. to position a new tool 2 in the workpiece shaping position. For this purpose, the tool holder is mounted on a rail 101 which can be movable together with the tool holder in the direction of the arrow A, i.e. in the working motion to deform the workpiece in the die. The hydraulics for displacing the tool 7 and away from the workpiece and for generating the forces required to deform the workpiece has not been illustrated.

The positioning means for shifting tool holder 1 on its rail can comprise a rack 5 attached to the tool holder 1 and having teeth engaging in the teeth of a pinion 6 which is mounted on the frame 10 and is driven by a lever 8 via an overrunning clutch 103 designed to unidirectionally advance the pinion in the clockwise sense while allowing free rotation of the lever 8 in the counterclockwise sense to restore the lever to its starting position for each stroke.

The gear 6 has an axial width equal to the width of the rack 5 placing the work stroke in the direction of arrow A so that the teeth of the rack slide along the teeth of the pinion 6 in the press working stroke.

A cylinder 7 connected to the frame 10 has a piston rod 17 articulated to the lever 8. The stroke of the piston rod 17 is limited by a stop collar 18 having a setscrew 104 enabling its adjustment along the piston rod 17. In each stroke, the piston rod 17 is drawn to the right until the collar 18 abuts the cylinder 7. The stop 18 thus defines the mechanism stroke of the piston rod 17.

The movement of the piston rod 17 is transmitted via the lever 8 to the pinion 6 so that a limited angular displacement is imparted to the latter as is also defined by the setting of the collar 18.

Rotation of the pinion 6 upon actuation of the cylinder 7 will displace the rack 5 and the tool holder 1 upwardly and from the position shown in FIGS. 1 and 2 will move the second tool 2 into the working position. When the tool change operation is completed, the piston rod 17 and the lever 8 return to their starting positions shown. These starting positions can also be set by an abutment. During this return movement, the overrunning clutch 103 prevents the pinion 6 and the shaft 9 from returning in the counterclockwise sense. As a result, the pinion will remain in its rotated position. The angular displacement of the pinion 6, as set by the collar 18 is such that each stroke of the piston rod 17 and each angular displacement of the pinion will advance the tool holder 1 by the distance D corresponding to the spacing between the tools and which is equal from tool to tool.

This positioning of each tool opposite the workpiece 4 is a coarse positioning and for fine positioning and arresting of the tool holder 1 in each new position, I provide the tool holder at an upper portion thereof with conical bores 12 having a spacing defined equal to the spacing D. A conical pin 11 can engage in the bores 12 to index the holder 1 in each position of alignment of a respective tool 2 with the workpiece 4. The conical shapes 13 of the bore 12 and the pin 11 make the tool holder self-centering for each working position on the pin.

Since the distances D' between the individual bores are equal to the distances D between the individual tools, a reproducible setting of each tool in the workpiece-shaping position is ensured.

Since the pin 11 locks the tool holder 1 in position, before each further movement B of the tool holder 1, the pin 11 must be withdrawn from the respective bore 12. However, during the press operation the pin 11 must remain in the bore 12 to ensure alignment of the tool 2 with the workpiece. As a consequence, a spring 14 acts upon the pin 11 to bias it into the bore 12. A lever 16 can be interposed between the spring 14 and the pin 11 so that the effect of the spring and the movement of the pin can be perpendicular to one another.

A pneumatic cylinder 15 can be actuated to act against the force of the spring 14 on the lever 16 to withdraw the pin 11 from the bore 12.

After unlocking of the tool holder in this fashion, the cylinder 7 can be actuated to shift the holder 1 into its next position to align a new tool 2 with the workpiece 4. The pneumatic cylinder 15 is then relieved to permit the spring 14 to press the pin back into the bore 12 and to accurately position the holder for alignment of the new tool.

To reduce the weight which must be displaced in the press operation, the shifting of the tool holder 1 is decoupled from the cylinder 7 and the pinion 6 and both the cylinder 7 and the pinion 6 are fixed to the frame 10 of the press. Only the tool holder 1 and its rail, together with the tools 2 are shifted toward the part 4 in the die 3.

To avoid decoupling of the rack 5 from the gear 6 during the press stroke, the gear 6 is a long gear wheel which maintains its engagement with the rack over the full press stroke, the teeth of the pinion and the rack sliding against one another during the press stroke.

Figure 3:
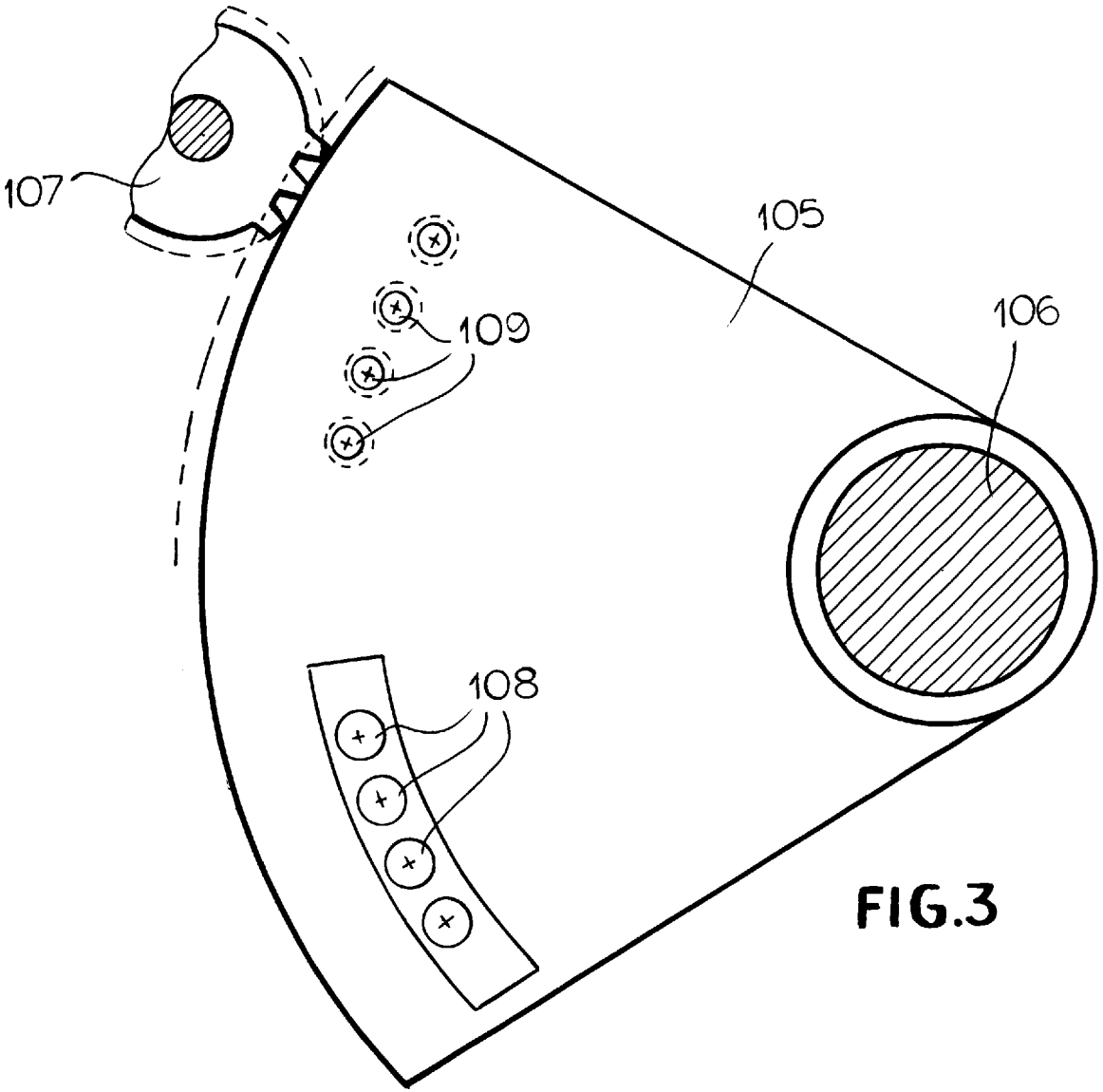
FIG. 3 is a view similar to FIG. 1 but showing a tool holder which can be rotated about an axis.

In FIG. 3 an alternative arrangement has been shown where a tool holder 105 is rotatable about a shaft 106 by a pinion 107 driven by a cylinder 7 in the manner described. The tools 108 are spaced on the tool holder 105 which has bores 109 engageable by a pin for the fine positioning. With the system of the invention, the press does not have to be brought to standstill for the changing of tools 2, 108 since the wear of the tool in the press position can be automatically monitored as a new tool is brought into position automatically when required.

If a sufficient number of tools are provided on the tool holder, operation can be maintained until some other part of the production system requires interruption, at which time the tool holder can be replaced. A stop 110 can be used to position the tool holder on the slide when the tool holder is to be replaced.

What is claimed is:

1. A tool-holder assembly for a machine tool comprising:

a workpiece holder;

a support movable toward and away from said workpiece holder with a working motion of said support;

a tool holder on aid support and having a plurality of identical tools fixed thereon for performing a certain machining operation and alternatively positionable at a workpiece-shaping position opposite said holder for identically performing said certain machining operation upon wear of each of said tools and substitution of one of said tools for another of said tools at said workpiece shaping position, said tool holder being movable on said support in a tool-replacement motion to substitute one of said tools for another of said tools at said position; and positioning means operatively connected with said tool holder for shifting said tool holder with said tool-replacement motion to substitute one of said tools for another at said workpiece-shaping position.

2. The tool-holder assembly defined in claim 1 wherein said machine tool is a press, said plurality of tools are press rams and said workpiece holder is a die receiving a workpiece and shaping workpieces in conjunction with said tool.

3. The tool-holder assembly defined in claim 2 wherein said tool holder is slidably mounted on a rail.

4. The tool-holder assembly defined in claim 1 wherein said tools are space apart from one another on said tool holder by equal distances.

5. The tool-holder assembly defined in claim 1 wherein said tool holder is angularly displaceable about an axis in said tool-replacement motion.

6. The tool-holder assembly defined in claim 1 wherein said positioning means coarsely positions said tools in succession at said workpiece-shaping position, said tool-holder assembly further comprising means for finely positioning and arresting said tool holder at said workpiece-shaping position.

7. The tool-holder assembly defined in claim 6 wherein the means for finely positioning and arresting the tool holder comprises a plurality of bores on said tool holder and a pin engageable selectively in said bores.

8. The tool-holder assembly defined in claim 7 wherein said pin and said bores have mutually-matching conical shapes.

9. The tool-holder assembly defined in claim 8 wherein said bores have mutual spacings corresponding to mutual spacings between tools.

10. The tool-holder assembly defined in claim 9 wherein said pin is spring-loaded into a selected one of said bores.

11. The tool-holder assembly defined in claim 10, further comprising a pneumatic cylinder for displacing said pin against a spring-loading force out of a selected bore.

12. The tool-holder assembly defined in claim 11, further comprising a lever operatively connected between said cylinder and said pin.

13. The tool-holder assembly defined in claim 5 wherein said tool holder, for positioning each tool in the workpiece-shaping position is displaced with a constant angular increment.

14. A tool-holder assembly for a machine tool comprising:

a workpiece holder;

a support movable toward and away from said workpiece holder with a working motion of said support;

a tool holder on aid support and having a plurality of identical tools fixed thereon for performing a certain machining operation and alternatively positionable at a workpiece-shaping position opposite said holder for identically performing said certain machining operation upon wearing of said tools and substitution of one of said tools for another of said tools at said workpiece shaping position, said tool holder being movable on said support in a tool-replacement motion to substitute one of said tools for another of said tools at said position; and positioning means operatively connected with said tool holder for shifting said tool holder with said tool-replacement motion to substitute one of said tools for another at said workpiece-shaping position, said positioning means including a pneumatic cylinder mounted on a machine frame and a pinion on said machine frame actuated by a piston of said cylinder for displacing said tool holder in said tool-replacement motion.

15. The tool-holder assembly defined in claim 14 wherein said tool holder is provided with a rack having teeth engaged by teeth of said pinion, the teeth of said pinion sliding on the teeth of said rack during displacement of said support toward and away from said workpiece holder in said working motion.

16. A press comprising:

a workpiece holder forming a die for holding a workpiece and shaping said workpiece;

a support movable toward and away from said workpiece holder with a working motion for shaping said workpiece;

a tool holder on said support and having a plurality of identical press rams constituting tools of said tool holder for shaping of the workpiece on said die and being alternatively positionable at a workpiece-shaping position opposite the workpiece holder upon wear of each press ram requiring replacement of the respective press ram, said tool holder being movable on said support in a tool-replacement motion to substitute another of said press rams for each worn press ram at said position; and positioning means operatively connected with said tool holder for shifting said tool holder with said tool-replacement motion to substitute said other of said press rams for each worn press ram at said position, said positioning means including a tooth rack formed on said tool holder, and a pinion having teeth engaged with said tooth rack for shifting said tool holder with said tool-replacement motion.

17. The press defined in claim 16 further comprising a lever connected with said pinion for rotating same and a pneumatic cylinder connected to said lever for actuating said lever.

18. The press defined in claim 17 wherein said pinion is mounted on its axis for overrunning operation.

19. The press defined in claim 18 wherein, for each actuation of said cylinder, said tools are advanced by a distance equal to a spacing of said tools on said tool holder.

20. A production machine comprising:

a workpiece holder for receiving workpieces to be shaped;

a tool holder having a plurality of identical tools adapted to be positioned individually opposite said die to perform the same operation for shaping said workpieces;

a rack connected with said tool holder for displacing said tools into position opposite said workpiece holder; and a pinion engaging said rack; and a pneumatic cylinder connected to said pinion for angularly displacing said pinion.

* * * * *